US005921085A

United States Patent [19]

Kawano

[11] Patent Number: 5,921,085

[45] Date of Patent: Jul. 13, 1999

[54] CONDENSER WITH BUILT-IN DEAERATOR AND STARTING/STOPPING METHODS OF THE SAME

[75] Inventor: Shunji Kawano, Yokohama, Japan

[73] Assignee: Kabushiki Kaisha Toshiba, Kawasaki, Japan

[21] Appl. No.: 08/655,093

[22] Filed: Jun. 4, 1996

[30] Foreign Application Priority Data

Jun. 8, 1995 [JP] Japan ..... 7-142017

[51] Int. Cl.[6] ..... F01K 13/02

[52] U.S. Cl. ..... 60/646; 60/657; 165/917

[58] Field of Search ..... 165/111, 917; 60/646, 657

[56] References Cited

U.S. PATENT DOCUMENTS 4,732,004 3/1988 Brand et al. ..... 60/646

FOREIGN PATENT DOCUMENTS 61-59187 3/1986 Japan .
3-275903 12/1991 Japan .
5-79776 3/1993 Japan .
5-296007 11/1993 Japan .
7-305973 11/1995 Japan .

*Primary Examiner*—Noah P. Kamen
*Attorney, Agent, or Firm*—Foley & Lardner

[57] ABSTRACT

A condenser with built-in deaerator comprises a main casing into which steam discharged from a turbine, a tube bank installed inside the main casing to condense the steam from the turbine, a hot well installed in the main casing to store steam condensate produced by the tube bank, a circulator for taking the steam condensate out from the hot well and returning the same again to the hot well, a gas injector having gas injecting heads, for injecting bubbles of an inert gas into the steam condensate stored in the hot well, and a water heater for heating the steam condensate in the vicinity of the gas injecting heads to increase the temperature of the steam condensate.

11 Claims, 3 Drawing Sheets

FIG. 2
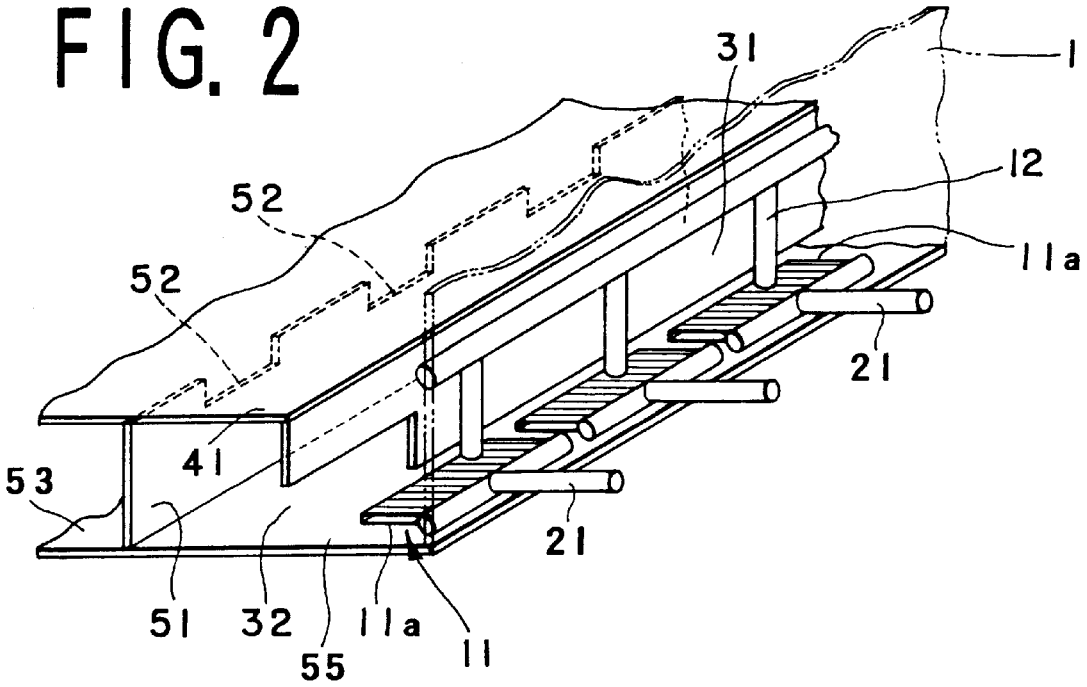
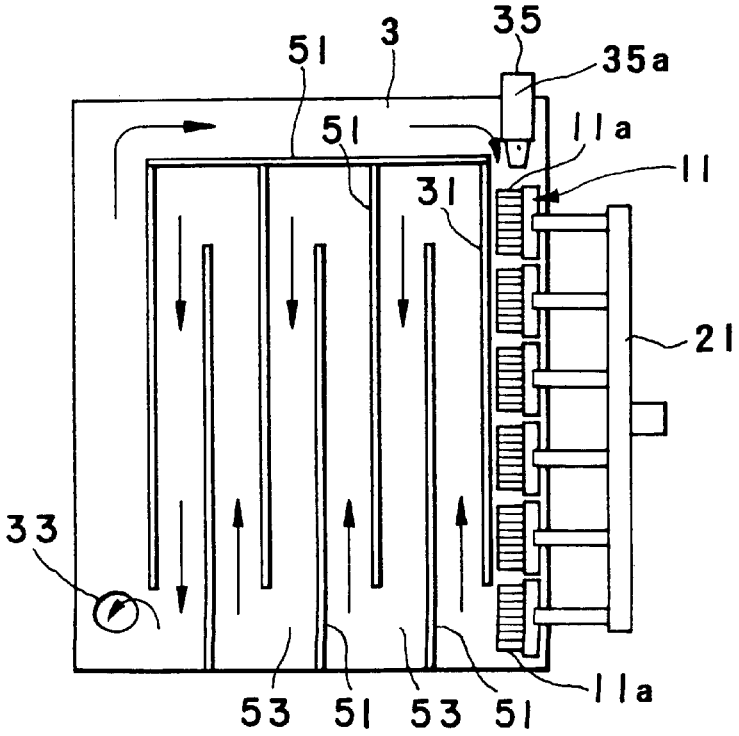
FIG. 3

CONDENSER WITH BUILT-IN DEAERATOR AND STARTING/STOPPING METHODS OF THE SAME

BACKGROUND OF THE INVENTION

1. Field of the Invention

The present invention relates to a condenser with built-in deaerator and a method of starting and stopping the same. More particularly, the present invention relates to a condenser with built-in deaerator for use in a combined steam and gas turbine cycle and a method of starting and stopping the same.

2. Description of the Related Art

It is known to operate a power plant of a combined steam and gas turbine cycle system in a daily start-stop (DSS) mode. In DSS mode the power plant is started and stopped repeatedly according to variations in daily power demand. When operating the power plant in DSS mode, reducing the time necessary to start the power plant is an important concern. Various techniques have been developed to solve this problem. The time required for reducing the dissolved oxygen concentration of boiler feedwater in the steam turbine cycle to a reference value is one of the factors dominating the time necessary to start the power plant of a combined steam and gas turbine cycle system. Boiler feedwater, in most cases, is stored in a condenser. The condenser is opened to the atmosphere while the operation of the power plant is stopped, because it is more economical to open the condenser to the atmosphere than to maintain a vacuum in the condenser while the power plant is stopped. However, when the condenser is opened to the atmosphere, steam condensate (boiler feedwater) stored in the condenser is exposed to the atmosphere. Oxygen contained in the atmosphere dissolves in the condensate, and the dissolved oxygen concentration of the boiler feedwater increases nearly to the point where the dissolved oxygen is saturated in the boiler feedwater. If the boiler feedwater containing a large concentration of oxygen is fed to a boiler, the equipment of the power plant will be corroded by electrochemical reactions. Therefore, oxygen contained in the boiler feedwater is removed by a deaerator to reduce the oxygen dissolved in the boiler feedwater to the lowest possible extent before feeding the boiler feedwater to the boiler. Currently, large-capacity power plants require a reference dissolved oxygen concentration of 7 ppb or below.

The deaerator removes oxygen dissolved in boiler feedwater by a solubility nonequilibrium reaction using direct contact between the boiler feedwater and a gas other than oxygen. Steam is usually used as the gas other than oxygen for deaeration.

A previously proposed deaerating method for a power plant of a combined steam and gas turbine cycle system employs a deaerator installed in a condenser. For example, a condenser of the type shown in FIG. 5 is disclosed in JP-A No. 3-275903. As shown in FIG. 5, a condenser 100 has a main casing 100*a* defining a space isolated from the external environment, and a tube bank 101 installed in the space defined by the main casing 100*a*. A vacuum pump 102 is connected to the tube bank 101 by a pipe. The tube bank 101 communicates with a separate hot well 103 by a pipe 104 provided with a shutoff valve 105. A deaerator 106 is disposed on the hot well 103 to deaerate steam condensate stored in the hot well 103. A feed pump 107 is connected by a pipe to the bottom of the hot well 103 to feed the steam condensate stored in the hot well 103 to a boiler, i.e., an apparatus that demands the steam condensate. A pipe 108 is branched from a pipe extending from the discharge side of the feed pump 107 and connected to an upper part of the deaerator 106 to form a circuit for circulating the steam condensate stored in the hot well 103 through the deaerator 106. A pipe 109 for supplying steam to the deaerator 106 is connected to a lower part of the deaerator 106.

In the conventional condenser 100 of this construction, the hot well 103 can be completely disconnected from the tube bank 101 by the shutoff valve 105. When the power plant is stopped, the hot well 103, which stores most of the steam condensate is isolated from the tube bank 101. The bank 101 is opened to the atmosphere while the power plant is stopped, and a vacuum is maintained therein to keep the steam condensate at a low oxygen concentration so that the steam condensate can be quickly fed from the condenser 100 to the boiler upon resumption of the operation of the power plant.

The condenser disclosed in JP-A No. 5-79776 or 5-296007 has a feed pipe connected to a hot well, and a deaerator combined with a tube bank to circulate the water stored in the hot well through the tube bank for deaeration.

However, in the foregoing condensers, part of the water is open to the atmosphere even though the hot well is isolated and a vacuum is maintained therein. The water, open to the atmosphere, is exposed to the atmosphere, so that oxygen dissolves therein. Drains flow from units of the power plant into the condenser even when the power plant is stopped. The drain capacity is as large as several tons, which is about 20 to 30% of the normal capacity of the hot well. The drains can be deaerated only by mixing the water contained in the hot well with water from the drains and circulating the mixture of water through the deaerator and the hot well. It is not possible to discharge the drains outside the system because the system must then make up for the quantity of water discharged from the drains.

Problems concerning the deaerator built in the conventional condenser will be enumerated below.

In the condenser without a hot well capable of maintaining vacuum, oxygen continues to dissolve in the water contained in the condenser until the oxygen concentration in the water reaches approximately its solubility. In that case, a large quantity of steam and a long time is required to reduce the concentration of the oxygen dissolved in the water to the reference oxygen concentration.

The condenser with a hot well capable of holding a vacuum, and a deaerator that blows steam into the steam condensate remaining in a tube bank also has problems. In that condenser, if steam is blown into the steam condensate immediately after the resumption of the operation of the condenser, the steam will instantly condense because the pressure in the condenser is relatively high and the condenser will not be sufficiently evacuated immediately after the resumption of the operation of the condenser. Consequently, the steam condensate is merely heated and is barely deaerated. Since the bubbles barely stir the water only the portion of the water which is above a level corresponding to a position from which steam is blown into the water is heated. Also, the deaerator that disperses water in steam requires a large space. The dearator has little deaerating ability because the partial pressure of air (oxygen) in a gas space for steam is high immediately after the start of the vacuum pump.

The conventional deaerator effectively dearates only after the vacuum of the condenser has increased, the water has been superheated beyond the saturation temperature, and the steam condensate has begun flash evaporation. However, only part of the steam condensate in the high-temperature surface layer of the steam condensate flashes, while the remaining deeper portion of the steam condensate does not flash because the deeper portion is not heated and remains cold. Therefore, the deeper portion of the steam condensate does not flash and is not deaerated.

SUMMARY OF THE INVENTION

Accordingly, it is an object of the present invention to provide an economical condenser with built-in deaerator, capable of solving those problems and of starting feeding water having a low oxygen concentration to an apparatus that requires the water in a short time. The condenser having a simple, compact construction does not require a large space for installation.

According to a first aspect of the present invention a condenser with a built-in deaerator comprises: a main casing into which steam discharged from a turbine flows, a tube bank installed inside the main casing to condense the steam from the turbine, a hot well installed in the main casing to store steam condensate produced by the tube bank, a circulator for taking the steam condensate out from the hot well and returning the same again to the hot well, a gas injector having gas injecting heads, for injecting bubbles of an inert gas into the steam condensate stored in the hot well, and a water heater for heating the steam condensate in the vicinity of the gas injecting members.

The term "inert" is used herein to describe a gas which has only limited ability to react chemically, and the term includes at least nitrogen gas, and rare gases, such as argon gas. Nitrogen gas is a suitable gas for the present invention. A gas other than nitrogen gas, such as argon gas, may be used instead of nitrogen gas.

In the condenser with built-in deaerator in accordance with the present invention, the gas injector may be provided with a gas heater for heating the inert gas at a temperature higher than that of the steam condensate stored in the hot well.

In the condenser with built-in deaerator in accordance with the present invention, the gas injector may be provided with a steam jetting means for jetting steam into the inert gas so that the inert gas contains steam of a partial pressure substantially equal to a saturation pressure at the temperature of the inert gas.

In the condenser with built-in deaerator in accordance with the present invention, the gas injecting heads are formed to have a shape substantially resembling a flat plate, by assembling a plurality of hollow fibers having a porous wall and the gas injecting heads, i.e., assemblies of the hollow fibers, are arranged substantially in parallel to the bottom plate of the main casing.

In the condenser with built-in deaerator in accordance with the present invention, a passage for the steam condensate may be formed in the hot well by setting a partition plate on the bottom plate of the main casing so that the upper edge thereof lies on a level higher than the normal level of the steam condensate contained in the hot well, and the gas injecting heads may be disposed in the passage.

In the condenser with built-in deaerator in accordance with the present invention, the circulator may be provided with a steam condensate returning part placed in the passage for the steam condensate to circulate the steam condensate.

In the condenser with built-in deaerator in accordance with the present invention, the water heater may be provided with steam jetting nozzles disposed directly above the gas injecting heads.

In the condenser with built-in deaerator in accordance with the present invention, the water heater may include a submerged steam jetting water heater combined with the circulator.

In the condenser with built-in deaerator in accordance with the present invention may further comprise a separating means for separating a portion of a gas space for gases extending over the steam condensate contained in the hot well from the tube bank and means to fill the gas space with water.

In the condenser with built-in deaerator in accordance with the present invention, the separating means may be a top plate spaced from the bottom plate of the main casing, disposed below the tube bank in the main casing and supported by a flat plate set upright on the bottom plate of the main casing so as to form a passage for the steam condensate, and the circulator may have a steam condensate outlet opening formed at one end of the passage for the steam condensate, and a steam condensate inlet opening formed at the other end of the passage for the steam condensate.

In the condenser with built-in deaerator in accordance with the present invention, the gas injecting heads may be disposed in the passage for the steam condensate.

According to a second aspect of the present invention, a method of starting a condenser with built-in deaerator comprising a main casing into which steam discharged from a turbine flows, a tube bank installed inside the main casing to condense the steam from the turbine, a hot well installed in the main casing to store steam condensate produced by the tube bank, a gas injector having gas injecting heads, for injecting bubbles of an inert gas into the steam condensate contained in the hot well, and a water heater for heating the steam condensate in the vicinity of the gas injecting heads comprises steps of: starting the injection of the inert gas into the steam condensate contained in the hot well by the gas injector before starting the evacuation of gases existing in the main casing and after the start of supplying cooling water to the tube bank, starting the heating of the steam condensate contained in the hot well by the water heater simultaneously with or a predetermined time after the start of the injection of the inert gas into the steam condensate, and continuously or intermittently injecting the inert gas into the steam condensate and continuously heating the steam condensate until the dissolved oxygen concentration of the steam condensate contained in the hot well reaches a predetermined dissolved oxygen concentration while reducing the pressure in the condenser to a predetermined pressure by evacuating gases from the main casing.

According to a third aspect of the present invention, a method of stopping a condenser with built-in deaerator comprising a main casing into which steam discharged from a turbine flows, a tube bank installed inside the main casing to condense the steam from the turbine, a hot well installed in the main casing to store steam condensate produced by the tube bank, and a separating means for separating a portion of a gas space extending over the steam condensate contained in the hot well from the tube bank comprises steps of: evacuating gases in the gas space separated by the separating means from the tube bank before supplying external air into the main casing, and filling up the space from which gases have been evacuated.

In the condenser with built-in deaerator in accordance with the present invention, the gas injector injects bubbles of the inert gas into the steam condensate to deaerate oxygen dissolved in the steam condensate. The inert gas injected into the steam condensate does not condense in the steam condensate, and comes effectively into contact with the steam condensate to achieve effective deaeration. Since the inert gas is injected into the steam condensate in the form of bubbles, the inert gas forms a surface of a large area in contact with the steam condensate and dissolved oxygen is taken efficiently into the bubbles. The water heater increases the temperature of part of the steam condensate in the vicinity of the gas injecting heads of the gas injector. The partial pressure of steam in the bubbles of the inert gas increases as the temperature of the steam condensate increases, whereby the diameter and the surface area of the bubbles are increased and the partial pressure of oxygen in the bubbles is decreased, so that more oxygen can further be taken into the bubbles of the inert gas.

In the condenser with built-in deaerator in accordance with the present invention, the gas heater heats the inert gas to a temperature higher than that of the steam condensate, and the gas injector injects the thus heated inert gas into the steam condensate. When the temperature of the inert gas is higher than that of the steam condensate, the steam condensate around the bubbles of the inert gas is easily evaporated into the bubbles. The steam evaporated from the steam condensate into the bubbles causes the bubbles to expand to enhance the dissolved oxygen deaerating effect of the bubbles.

In the condenser with built-in deaerator in accordance with the present invention, the steam jetting means makes the inert gas contain steam of a partial pressure substantially equal to a saturation pressure at the temperature of the inert gas. The gas injector injects the inert gas containing steam into the steam condensate. Bubbles of the inert gas containing steam are easily expanded in the steam condensate. The steam promotes the expansion of the bubbles in the steam condensate to enhance the dissolved oxygen deaerating effect of the bubbles.

In the condenser with built-in deaerator in accordance with the present invention, the gas injector injects the inert gas into the steam condensate through the gas injecting heads each comprising a plurality of hollow fibers having a porous wall and assembled in a shape substantially resembling a flat plate. The inert gas injected into the steam condensate through the gas injecting heads formed by arranging hollow fibers efficiently forms numerous minute bubbles, which scarcely merge with each other, in the steam condensate. Accordingly, the total surface area of the bubbles is very large, thereby enhancing the dissolved oxygen deaerating effect of the bubbles.

In the condenser with built-in deaerator in accordance with the present invention, the partition plate has an upper edge on a level above the normal level of the steam condensate and forms the passage for the steam condensate. The passage determines the flowing direction of the steam condensate.

In the condenser with built-in deaerator in accordance with the present invention, the steam condensate returning part of the circulator returns the steam condensate to the passage for the steam condensate, thereby enabling efficient deaeration of oxygen dissolved in the steam condensate.

In the condenser with built-in deaerator in accordance with the present invention, the water heater jets steam into the steam condensate through the steam jetting nozzle disposed directly above the gas injecting heads. The steam jetted into the steam condensate heats the steam condensate, and the heated steam condensate promotes the expansion of the bubbles of the inert gas injected into the steam condensate, thereby enhancing the dissolved oxygen deaerating effect of the bubbles.

In the condenser with built-in deaerator in accordance with the present invention, the water heater heats the steam condensate flowing through the passage of the circulator using a submerged steam jetting water heater, so that the steam condensate can be uniformly heated. The deaeration of dissolved oxygen is thereby promoted.

In the condenser with built-in deaerator in accordance with the present invention, the separating means separates a portion of a gas space extending over the steam condensate contained in the hot well from the tube bank, so that water staying in the separated portion of the gas space is not exposed to air when air is supplied into the main casing of the condenser. Hence oxygen contained in the air does not dissolve in the water staying in the separated portion of the gas space.

In the condenser with built-in deaerator in accordance with the present invention, the passage for the steam condensate formed by the flat plates determines the flowing direction of the steam condensate in the hot well. The steam condensate outlet opening of the circulator formed at one end of the passage for the steam condensate permits the steam condensate to flow out of the hot well. The steam condensate inlet opening formed at the other end of the passage for the steam condensate permits the steam condensate to flow into the hot well. Consequently, the steam condensate is forced to flow in one direction in the hot well so that the entire steam condensate passes by the gas injecting heads of the gas injector. Accordingly, bubbles of the inert gas can be uniformly distributed throughout the steam condensate, thereby enhancing the dissolved oxygen deaerating effect of the bubbles. Since the top plate is supported on the flat plates, a tube bank structure can be mounted on the top plate without any top plate problems.

In the condenser with built-in deaerator in accordance with the present invention, bubbles of the inert gas can be uniformly distributed throughout the steam condensate by injecting the inert gas into the steam condensate through the gas injecting heads disposed in the passage for the steam condensate, thereby enhancing the dissolved oxygen deaerating effect.

A method of starting the condenser with built-in deaerator in accordance with the present invention starts the injection of the inert gas into the steam condensate contained in the hot well using a gas injector before beginning to evacuate gases existing in the main casing and after beginning to pass cooling water through the tube bank. Therefore, the method provides sufficient time for bubbles of the inert gas to be uniformly distributed throughout the steam condensate. The method starts the heating of the steam condensate simultaneously with or a predetermined time after the start of the injection of the inert gas into the steam condensate to control the dissolved oxygen deaerating action through the control of the expansion of the bubbles in the steam condensate. The method injects the inert gas continuously or intermittently into the steam condensate and heats the steam condensate continuously until the dissolved oxygen concentration of the steam condensate contained in the hot well reaches a predetermined dissolved oxygen concentration while reducing the pressure in the condenser to a predetermined pressure.

The method of stopping the condenser with built-in deaerator evacuates gases in the gas space separated by the separating means from the tube bank before supplying external air into the condenser, and fills up the space from which gases have been evacuated with water. Accordingly, the air is unable to flow into the separated gas space and oxygen contained in the air may not dissolve in the steam condensate staying in the separated gas space.

BRIEF DESCRIPTION OF THE DRAWINGS

Preferred embodiments of the present invention will become understood from the following detailed description referring to the accompanying drawings, in which:

FIG. 2 is a fragmentary perspective view of a portion A in FIG. 1;

FIG. 3 is a schematic cross-sectional view of a lower portion of the condenser with built-in deaerator of FIG. 1;

DETAILED DESCRIPTION OF THE PREFERRED EMBODIMENTS

Figure 1:
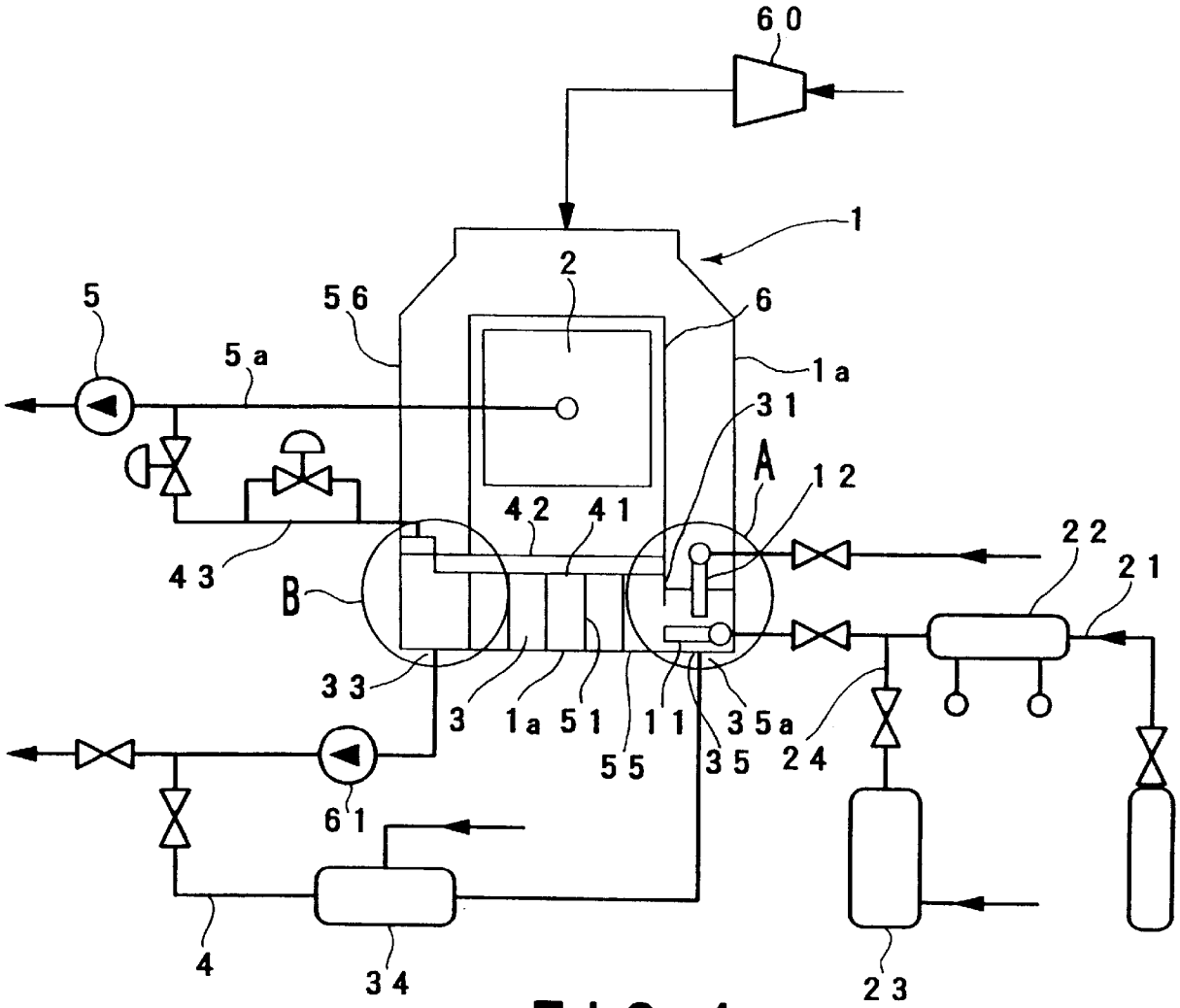
FIG. 1 is a diagrammatic longitudinal sectional view of a condenser with built-in deaerator in a preferred embodiment according to the present invention.
Figure 4:
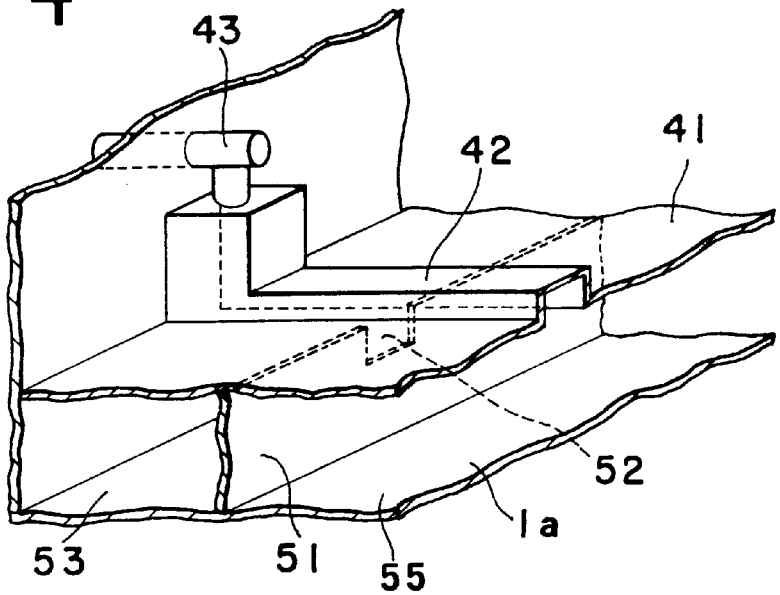
FIG. 4 is a perspective view of a portion B in FIG. 1.
Figure 5:
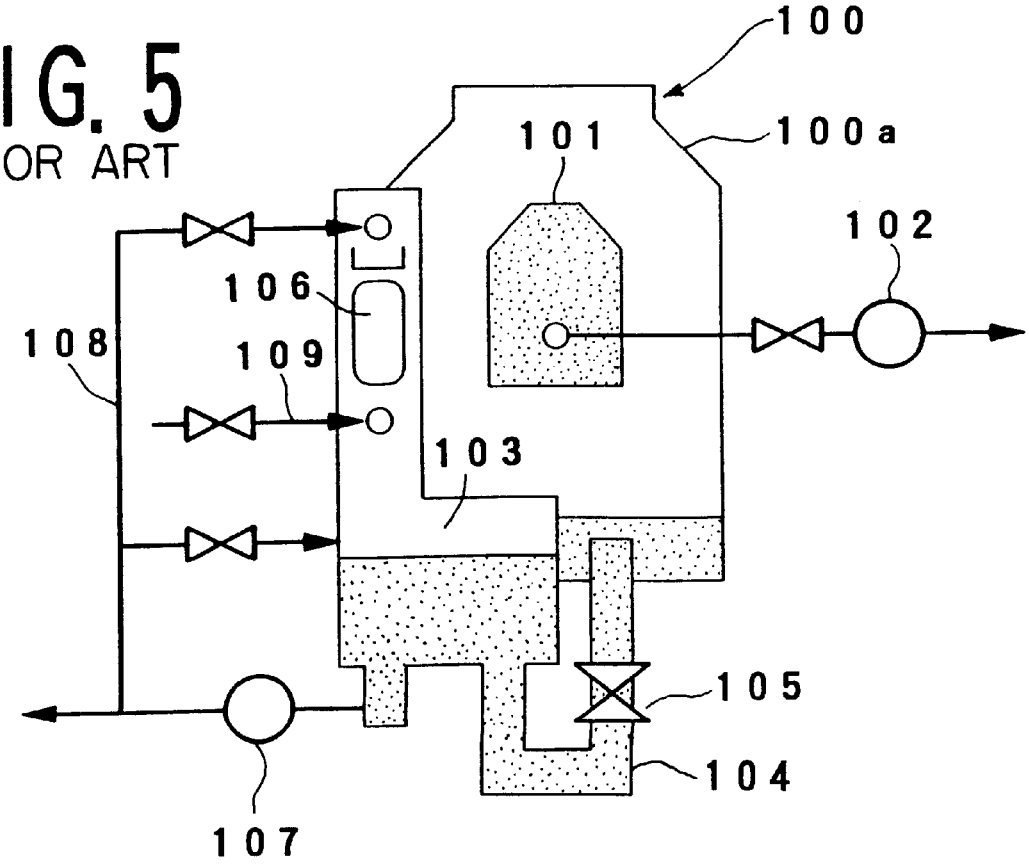
FIG. 5 PRIOR ART
FIG. 5 is a diagrammatic longitudinal sectional view of a conventional condenser.

A condenser with built-in deaerator in a preferred embodiment according to the present invention will be described with reference to FIGS. 1 to 4.

A condenser with built-in deaerator 1 in the first embodiment has a main casing 1*a*. A tube bank 2 is installed in a confined space enclosed by the main casing 1*a*. The tube bank 2 is connected to a vacuum pump 5 by a pipe 5*a*. A hot well 3 is installed in the lower part of the interior of the main casing 1*a* to store steam condensate produced by cooling steam by the tube bank 2. A plurality of porous, hollow fibers (gas injecting members) 11*a* are arranged on one side of the hot well 3 to inject bubbles of an inert gas into the steam condensate. The gas injecting members 11*a* are extended in parallel to the bottom plate 55 of the main casing 1*a* to form gas injecting heads 11 having the shape of a flat plate. The porous, hollow fibers 11*a* are those of a polymer, such as a polyethylene, or a ceramic material.

Steam injecting nozzles (water heating means) 12 are disposed above the porous, hollow fibers 11*a* in the hot well 3 to jet steam into the steam condensate. An inert gas supply pipe 21 is connected to the porous, hollow fibers 11*a*. An electric heater 22 is placed in the pipe 21. The electric heater 22 is able to heat the inert gas at a temperature higher than that of the steam condensate (feedwater) contained in the hot well 3. A pipe 21 branched from the pipe 21 is connected to a boiler (steam injecting means) 23. Steam supplied from the boiler 23 through the pipe 24 can be mixed in the inert gas. The boiler 23 is able to mix steam in the inert gas by providing a partial pressure substantially equal to a saturation pressure at the inert gas temperature. The electric heater 22 may instead be a steam type heater, a hot water type heater, a gas type heater or any suitable type heater.

As shown in FIG. 1, the porous, hollow fibers 11*a* are disposed in an elongate passage. The elongate passage is defined by a side plate 56 of the main casing 1*a*, and a partition plate 31 disposed in the main casing 1*a*. As shown in FIG. 2, the partition plate 31 has an upper edge extending above the normal level of the steam condensate. A recess 32 in the partition plate 31 together with the bottom plate 55 of the main casing 1*a* define an opening. As shown in FIG. 1, a steam condensate circulating circuit 4 has a steam condensate outlet opening 33 formed in one corner of the bottom plate 55 of the main casing 1*a* to circulate the steam condensate. The steam condensate circulating circuit 4 has an in-line submerged steam jetting water heater (water heating means) 34 to jet steam into the steam condensate and heat the steam condensate. The steam condensate circulating circuit 4 has a steam condensate inlet opening 35. The opening 35 is in the corner of the bottom plate 55 diametrically opposite to the corner which has the steam condensate outlet opening 33. The steam condensate inlet opening is in the passage in which the gas injecting heads 11 is disposed. A nozzle 35*a* is disposed near the steam condensate inlet opening 35 to accelerate currents of the steam condensate.

A top plate 41 is disposed in a section of the interior of the main casing 1*a* other than a section in which the porous, hollow fibers 11*a* are arranged. The top plate 41 separates the hot well 3 from the tube bank 2. A support plate 6 is set on the top plate 41 to prevent the tube bank 2 from bending. A ridge 42 defining a channel is formed in a portion of the top plate 41. A pipe 43 is connected to the ridge 42. The pipe 43 is also connected to a vacuum pump 5 (shown in FIG. 1), for evacuating gases from the interior of the main casing 1*a*.

A plurality of flat plates 51 are set upright between the bottom plate 55 of the main casing 1*a* and the top plate 41 to support the top plate 41 and to define a passage 53 as shown in FIG. 3. FIG. 3 is a cross-sectional view of a lower portion of the condenser 1 including the hot well 3. As shown in FIG. 2, each flat plate 51 has a plurality of recesses 52 in its upper edge. The adjacent sections of the passage 53 may communicate with each other by means of the recesses 52. The passage 53 extends throughout the hot well 3. The steam condensate outlet opening 33, the steam condensate inlet opening 35 and the gas injecting heads 11 comprising the porous, hollow fibers 11*a* are all disposed in the passage 53.

The operation of the condenser with built-in deaerator embodying the present invention will be described hereinafter.

Referring to FIG. 1, steam discharged from the turbine 60 flows into the main casing 1*a*, and then the tube bank 2 cools the steam to condense the steam into steam condensate. The hot well 3 stores the steam condensate. A feed pump 61 pumps the steam condensate through the steam condensate outlet opening 33 and feeds the steam condensate to an apparatus that uses the steam condensate (boiler).

The pipe 21 supplies inert gas heated by the heater 22 to the gas injecting heads 11 comprising the porous, hollow fibers 11*a*, and injects bubbles of the inert gas through the gas injecting heads 11 into the steam condensate contained in the hot well 3. Oxygen dissolved in the steam condensate is taken into the bubbles of the inert gas for deaeration. The inert gas may be nitrogen gas. Argon gas or other inert gas may also be used. Since the inert gas does not easily dissolve in water, the bubbles of the inert gas effectively maintain contact surfaces with the steam condensate and take oxygen therein.

As mentioned above, the gas injecting heads 11 is formed in the shape of a flat plate by assembling the porous, hollow fibers 11*a* and arranged in parallel to the bottom plate 55 of the main casing 1*a*. Therefore, the inert gas is injected into the steam condensate in minute bubbles of very small diameters on the order of 1 micron. The bubbles scarcely merge with each other to grow into greater bubbles. Accordingly, the inert gas can be effectively injected into the steam condensate in numerous minute bubbles thereby forming large area contact surfaces. Since oxygen dissolved in the steam condensate is deaerated by the agency of the bubbles dispersed in the steam condensate, the deaerator does not require a very large space. Therefore, the dimensions of the condenser 1 need not be increased.

The steam injecting nozzles 12 are disposed directly above the gas injecting heads 11 comprising the porous, hollow fibers 11*a*. The steam injecting nozzles 12 jet steam into the steam condensate to increase the temperature of the steam condensate in a zone in which the bubbles of the inert gas are formed. Consequently, the temperature of the steam condensate surrounding the bubbles of the inert gas is increased, and the partial pressure of steam in the bubbles increases expanding the bubbles. Therefore, the surface areas of the bubbles increases which increases the area of contact with oxygen, and the partial pressure of oxygen in the bubbles is reduced. Consequently, the bubbles can take a further increased quantity of oxygen.

As mentioned above, the heater 22 heats the inert gas at a temperature higher than that of the steam condensate. When the inert gas is thus heated, the evaporation of the steam condensate around the bubbles of the inert gas into the bubbles is promoted, and the bubbles take in the evaporated steam condensate expanding the bubbles. Steam generated by the boiler 23 is supplied through the pipe 24 into the inert gas supply pipe 21 and mixed in the inert gas. The partial pressure of the steam is substantially equal to a saturation pressure at the temperature of the inert gas. Consequently, the bubbles are formed in the steam condensate in diameters which can easily be increased. Hence the expansion of the bubbles is further promoted.

The partition plate 31 disposed near the gas injecting heads 11 comprising the porous, hollow fibers 11*a,* define an elongate bubble producing zone. The steam condensate contained in the hot well 3 flows along the partition plate 31. A portion of the partition plate 31 provided with the recess 32 forms a drowned weir. The drowned weir allows the steam condensate to flow through an opening defined by the recess 32 and dams up gases.

The steam condensate that flows through the steam condensate outlet opening 33 into the steam condensate circulating circuit 4 is heated by the in-line submerged steam jetting water heater 34 included in the steam condensate circulating circuit 4. The thus heated steam condensate is returned through the steam condensate inlet opening 35 into the inert gas bubble producing zone in the hot well 3. Thus, the steam condensate which does not contain the inert gas bubbles can be heated thereby producing inert gas bubbles in the heated steam condensate. Thereby, the steam condensate contained in the hot well can be heated uniformly and inert gas bubbles can be produced in the steam condensate.

The top plate 41 separates a space in which the hot well 3 is installed from a space in which the tube bank 2 is installed. The ridge 42 is formed in a portion of the top plate 41. The ridge 42 forms a gas space that is not filled up with the steam condensate even if the level of the steam condensate in the hot well 3 rises to the highest level. Gases existing in the hot well 3 collect in the gas space formed by the ridge 42. The gases collected in the gas space are evacuated by the vacuum pump 5 to remove the gases entirely from the separated space. Accordingly, when air is supplied into the main casing 1*a* of the condenser 1, the steam condensate contained in the hot well 3 is not exposed to air. Therefore, oxygen contained in the air does not easily dissolve in the steam condensate.

Since the top plate 41 is supported by the flat plates 51 set on the bottom plate 55 of the main casing 1*a,* the support plate 6 for preventing the tube bank 2 from bending mounted on the top plate 41 does not need any additional support structure for supporting the support plate 6 on the bottom plate 55 of the main casing 1*a*. Therefore, the condenser 1 can be formed in a simple construction. The flat plates 51 also serve as guide plates for forming the passage 53 in the hot well 3 and determining the steam condensate flow direction in the hot well 3. Unidirectional currents of the steam condensate can be produced in the hot well 3 by placing the steam condensate outlet opening 33, the steam condensate inlet opening 35, the nozzle 35*a* and the gas injecting heads 11 comprising the porous, hollow fibers 11*a,* in the passage 53. The nozzle 35*a*, disposed near the steam condensate inlet opening 35, makes the steam condensate flow through the passage 53 at a flow rate greater than that at which the steam condensate flows through the steam condensate circulating circuit 4. Consequently, a large quantity of the steam condensate contained in the hot well 3 can be made to efficiently flow past the gas injecting heads 11 comprising the porous, hollow fibers 11*a*. Therefore, the bubbles of inert gas produced by the porous hollow fibers 11*a* can be dispersed uniformly and quickly into the entire steam condensate contained in the hot well 3.

As is apparent from the foregoing description, in the condenser 1 embodying the present invention, infinitely numerous minute bubbles of inert gas are produced and uniformly dispersed in the steam condensate. The temperature of the bubbles is increased to easily expand the bubbles. Bubble expansion is promoted by mixing steam in the inert gas before producing the inert gas bubbles. Therefore, the bubbles are able to expand quickly when the interior of the main casing 1*a* is evacuated by the vacuum pump. Oxygen dissolved in the steam condensate around the bubbles can quickly be taken into the bubbles. Therefore, the dissolved oxygen concentration of the steam condensate can be reduced in a very short time.

Since most of the steam condensate contained in the hot well is separated from the tube bank 2 by the top plate 41, the dissolution of oxygen in the steam condensate can effectively be prevented even if external air is introduced into the main casing 1*a* provided that the duration of stoppage of the plant is on the order of several hours. Therefore, the steam condensate can be fed to the apparatus that uses the steam condensate in a very short time after the operation of the power plant has been resumed.

These effects remarkably reduce the time necessary for starting the operation of the power plant employing the condenser 1 and reduce the power and steam expenses necessary for resuming the operation of the plant.

A method of starting the condenser 1 with built-in deaerator in the foregoing embodiment will be described.

In the first step in starting the condenser 1 with built-in deaerator, cooling water is supplied to the tube bank 2. The vacuum pump 5 is started after the cooling water supply system has stabilized. The vacuum pump reduces the pressure in the interior of the main casing 1*a* by evacuating gases from the interior of the main casing 1*a*. The time between the start of the supply of cooling water and the start of the vacuum pump 5 is dependent on the system. The injection of the inert gas through the gas injecting head 11 comprising the porous, hollow fibers 11*a,* into the steam condensate is started before the vacuum pump 5 is started. The steam condensate is heated by the steam jetting nozzles 12 and the in-line submerged steam jetting water heater 34 may be started either simultaneously with, or a predetermined time after, the gas jetting heads 11 start producing inert gas bubbles.

A sufficiently long time is available for uniformly distributing bubbles in the steam condensate, because the gas injecting heads 11 begin injecting inert gas into the steam condensate before the vacuum pump is started. The heating of the steam condensate by steam jetted through the steam jetting nozzles 12 and the submerged steam jetting water heater 34 may be started either simultaneously with, or an optional time after, the gas injecting heads begin producing inert gas bubbles. Therefore, the start of the inert gas bubble expansion can be controlled to control the deaerating action of the inert gas bubbles to take oxygen dissolved in the steam condensate into the bubbles.

A method of stopping the condenser 1 with built-in deaerator in the foregoing embodiment will be explained.

In the first step in stopping the condenser 1 with built-in deaerator, gases existing in a space in the hot well 3 separated from the tube bank 2 are evacuated through the space defined by the ridge 42 and the pipe 43 by the vacuum pump 5. The evacuated space is filled up with water before introducing external air into the main casing 1*a* of the condenser 1 to prevent the air from flowing into the evacuated space. If the level of the steam condensate in the passage formed between the partition wall 31 and the side wall of the main casing 1*a* is lower than the upper end of the opening formed by the recess 32 formed in one end of the partition plate 31, the hot well 3 is replenished with water to maintain the level of the steam condensate above the upper end of the opening formed by the recess 32.

Gases existing in a space in the hot well 3 separated from the tube bank 2 are evacuated and the evacuated space is filled up with water before introducing external air into the main casing 1*a* of the condenser 1. Therefore, air is unable to flow into the evacuated space and the dissolution of oxygen contained in the air into the steam condensate can be prevented. Air is not able to flow into the hot well 3, because the level of the steam condensate is always higher than the upper end of the opening formed by the recess 32.

In the condenser with built-in deaerator in accordance with the present invention, the gas injector injects inert gas bubbles into steam condensate contained in the hot well, and the water heater increases the temperature of the steam condensate in the vicinity of the gas injector. Therefore, oxygen dissolved in the steam condensate contained in the hot well can be removed very quickly, and costs necessary for deaeration, such as power consumption, can be reduced. Furthermore, feedwater having a low dissolved oxygen concentration can be fed to an apparatus that uses the steam condensate in a short time. Consequently, the power plant utilization efficiency can be improved. Also, the hot well space for the present invention need not be greater than that for the hot well of the conventional condenser, because oxygen dissolved in the steam condensate can be deaerated very quickly and efficiently by the inert gas bubbles. Furthermore, dissolved oxygen can properly be deaerated without forming the condenser of a size greater than the equivalent conventional condenser size.

In the condenser with built-in deaerator in accordance with the present invention, the inert gas has a temperature higher than the temperature of the steam condensate contained in the hot well. The higher temperature inert gas is injected into the steam condensate by the gas injector thereby enhancing the deaeration efficiency and speed of oxygen dissolved in the steam condensate.

In the condenser with built-in deaerator in accordance with the present invention, the gas injector for injecting the inert gas into the steam condensate comprises gas injecting heads formed by assembling porous, hollow fibers , where the gas injection heads have a shape substantially resembling a flat plate. Therefore, the efficiency and speed of deaeration of oxygen dissolved in the steam condensate is enhanced.

In the condenser with built-in deaerator in accordance with the present invention, the gas injector is disposed in the passage for the steam condensate defined by the partition plate. Therefore, oxygen dissolved in the steam condensate can be deaerated uniformly and efficiently.

In the condenser with built-in deaerator in accordance with the present invention, the steam condensate is circulated through the passage for the steam condensate and the steam condensate inlet opening formed in the passage for the steam condensate. Therefore, the deaeration efficiency of oxygen dissolved in the steam condensate can be enhanced.

In the condenser with built-in deaerator in accordance with the present invention, the water heater jets steam through the steam jetting nozzles disposed directly above the gas injector into the steam condensate. Therefore, the deaeration efficiency of oxygen dissolved in the steam condensate can be enhanced.

In the condenser with built-in deaerator in accordance with the present invention, the water heater heats the steam condensate flowing through the passage of the circulator by the submerged steam jetting water heater. Therefore, the steam condensate can be heated uniformly and efficiently, and the deaeration efficiency and speed of dissolved oxygen is enhanced.

In the condenser with built-in deaerator in accordance with the present invention, the separating means separates a portion of a gas space extending over the steam condensate contained in the hot well from the tube bank. Therefore, the steam condensate remaining in the separated portion of the gas space is not exposed to air when air is supplied into the main casing of the condenser. Oxygen contained in the air may not dissolve in the steam condensate remaining in the separated portion of the gas space. Therefore, oxygen dissolved in the steam condensate can be deaerated in a very short time when starting the power plant.

In the condenser with built-in deaerator in accordance with the present invention, the passage for the steam condensate is formed by flat plates. The steam condensate outlet opening of the circulator is formed at one end of the passage for the steam condensate, and permits the steam condensate to flow out of the hot well. The steam condensate inlet opening is formed at the other end of the passage for the steam condensate, and permits the steam condensate to flow into the hot well. Therefore, inert gas bubbles can be distributed uniformly throughout the steam condensate and hence the bubbles deaerating effect on the dissolved oxygen is enhanced. Since the top plate is supported on the flat plates, the tube bank structure can be mounted on the top plate. Therefore, the condenser internal construction can be simplified.

According to the method of starting the condenser with built-in deaerator in accordance with the present invention, the gas injector starts the inert gas injection into the steam condensate contained in the hot well before the evacuation of gases in the main casing is started, and after the passing of cooling water through the tube bank is started. Therefore, the heating of the steam condensate is started simultaneously with, or a predetermined time after, the inert gas injection into the steam condensate is started. The inert gas is injected either continuously or intermittently into the condensed gas. The steam condensate is heated continuously until the dissolved oxygen concentration of the steam condensate contained in the hot well reaches a predetermined dissolved oxygen concentration. The pressure in the condenser is reduced to a predetermined pressure. Therefore, oxygen dissolved in the steam condensate can quickly and properly be deaerated before starting the condenser.

The method of stopping the condenser with built-in deaerator evacuates gases in the gas space separated by the separating means from the tube bank and fills up the space from which gases have been evacuated before supplying external air into the condenser. Therefore, the air is unable to flow into the separated gas space, and oxygen contained in the air does not dissolve in the steam condensate remaining in the separated gas space. Therefore, oxygen dissolved in the steam condensate can be removed quickly when resuming the operation of the power plant.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A condenser with built-in deaerator comprising:

a main casing into which a steam discharged from a turbine;

a tube bank installed inside the main casing to condense the steam from the turbine;

a hot well installed in the main casing to store a steam condensate produced by the tube bank;

circulating means for taking the steam condensate out from the hot well and returning the steam condensate again to the hot well;

gas injecting means having gas injecting heads, for injecting bubbles of an inert gas into the steam condensate stored in the hot well; and water heating means for heating the steam condensate in the vicinity of the gas injecting heads to increase the temperature of the steam condensate, wherein the gas injecting heads are shaped substantially resembling a flat plate, by assembling a plurality of hollow fibers having a porous wall, and the gas injecting heads are arranged substantially parallel to a bottom plate of the main casing.

2. A condenser with built-in deaerator comprising:

a main casing into which a steam discharged from a turbine;

a tube bank installed inside the main casing to condense the steam from the turbine;

a hot well installed in the main casing to store a steam condensate produced by the tube bank;

circulating means for taking the steam condensate out from the hot well and returning the steam condensate again to the hot well;

gas injecting means having gas injecting heads, for injecting bubbles of an inert gas into the steam condensate stored in the hot well; and water heating means for heating the steam condensate in the vicinity of the gas injecting heads to increase the temperature of the steam condensate, wherein the water heating means has steam jetting nozzles disposed directly above the gas injecting heads.

3. The condenser with built-in deaerator according to claim 1, wherein the gas injecting means is provided with a gas heating means for heating the inert gas at a temperature higher than that of the steam condensate stored in the hot well.

4. The condenser with built-in deaerator according to claim 3, wherein the gas injecting means is provided with a steam jetting means for jetting steam into the inert gas so that the inert gas contains steam of a partial pressure substantially equal to a saturation pressure at the temperature of the inert gas.

5. The condenser with built-in deaerator according to claim 2, wherein a passage for a steam condensate is formed in the hot well by setting a partition plate on a bottom plate of the main casing so that the upper edge thereof lies on a level higher than the normal level of the steam condensate contained in the hot well, and the gas injecting heads are disposed in the passage.

6. The condenser with built-in deaerator according to claim 5, wherein the circulating means is provided with a steam condensate returning part placed in the passage for the steam condensate to circulate the steam condensate therethrough.

7. The condenser with built-in deaerator according to claim 2, wherein the water heating means includes a submerged steam jetting water heater combined with the circulating means.

8. A condenser with built-in deaerator comprising:

a main casing into which a steam discharged from a turbine;

a tube bank installed inside the main casing to condense the steam from the turbine;

a hot well installed in the main casing to store a steam condensate produced by the tube bank;

circulating means for taking the steam condensate out from the hot well and returning the steam condensate again to the hot well;

gas injecting means having gas injecting heads, for injecting bubbles of an inert gas into the steam condensate stored in the hot well;

water heating means for heating the steam condensate in the vicinity of the gas injecting heads to increase the temperature of the steam condensate; and a separating means for separating a portion of a gas space for gases extending over the steam condensate contained in the hot well from the tube bank, wherein the separating means is a top plate spaced from the bottom plate of the main casing and disposed below the tube bank in the main casing, further including flat plates set upright on the bottom plate of the main casing so as to support the top plate and to form a passage for the steam condensate, wherein the circulating means has, in the hot well, a steam condensate outlet opening and a steam condensate inlet opening, and wherein the steam condensate outlet opening is formed in one end of the passage for the steam condensate, and the steam condensate inlet opening is formed in the other end of the passage for the steam condensate.

9. The condenser with built-in deaerator according to claim 8, wherein the gas injecting heads are disposed in a section of the passage for the steam condensate.

10. A method of starting a condenser with built-in deaerator comprising a main casing into which steam discharged from a turbine flows, a tube bank installed inside the main casing to condense the steam from the turbine, a hot well installed in the main casing to store steam condensate produced by the tube bank, a gas injecting means having gas injecting heads, for injecting bubbles of an inert gas into the steam condensate contained in the hot well, and a water heating means for heating the steam condensate in the vicinity of the gas injecting heads, said method comprising steps of:

starting the injection of the inert gas into the steam condensate contained in the hot well by the gas injecting means before starting the evacuation of gases existing in the main casing and after the start of supplying cooling water to the tube bank;

starting the heating of the steam condensate contained in the hot well by the water heating means simultaneously with or a predetermined time after the start of the injection of the inert gas into the steam condensate; and continuously or intermittently injecting the inert gas into the steam condensate and continuously heating the steam condensate until the dissolved oxygen concentration of the steam condensate contained in the hot well reaches a predetermined dissolved oxygen concentration while reducing the pressure in the condenser to a predetermined pressure by evacuating gases from the main casing.

11. A method of stopping a condenser with built-in deaerator comprising a main casing into which steam discharged from a turbine flows, a tube bank installed inside the main casing to condense the steam from the turbine, a hot well installed in the main casing to store steam condensate produced by the tube bank, and a separating means for separating a portion of a gas space extending over the steam condensate contained in the hot well from the tube bank, said method comprising steps of:

evacuating gases from the gas space separated by the separating means from the tube bank before supplying external air into the main casing; and filling up the gas space from which gases have been evacuated with water.

* * * * *